US005156017A

United States Patent [19]

Smith et al.

[11] Patent Number: 5,156,017

[45] Date of Patent: Oct. 20, 1992

[54] REFRIGERATION SYSTEM SUBCOOLING FLOW CONTROL VALVE

[75] Inventors: Owen S. Smith, Powell, Ohio; Carl N. Johnson, Colleyville, Tex.

[73] Assignee: Ranco Incorporated of Delaware, Wilmington, Del.

[21] Appl. No.: 671,370

[22] Filed: Mar. 19, 1991

[51] Int. Cl.[5] ..... F25B 41/00

[52] U.S. Cl. ..... 62/210; 62/216

[58] Field of Search ..... 62/214, 216, 222, 498; 236/93 A, 93 R

[56] References Cited

U.S. PATENT DOCUMENTS

| | | | |
|---|---|---|---|
| 2,221,062 | 11/1940 | Starr | 236/93 UX |
| 2,481,968 | 9/1949 | Atchison | 62/127 |
| 3,037,362 | 6/1962 | Tilney et al. | 62/117 |
| 3,296,816 | 1/1967 | Weibel, Jr. et al. | 62/217 |
| 3,367,130 | 2/1968 | Owens | 62/222 |
| 3,388,558 | 6/1968 | Harnish | 62/196 |
| 3,537,272 | 11/1970 | Hales et al. | 62/157 |
| 3,564,865 | 2/1971 | Spencer et al. | 62/197 |
| 3,886,761 | 6/1975 | Santini | 62/217 |
| 3,942,333 | 3/1976 | Kish | 62/217 |
| 4,067,203 | 1/1978 | Behr | 62/208 |
| 4,112,703 | 9/1978 | Kountz | 62/211 |
| 4,254,634 | 3/1981 | Akio et al. | 62/217 |
| 4,267,702 | 5/1981 | Houk | 62/115 |
| 4,335,742 | 6/1982 | Jacyno | 62/217 |
| 4,429,552 | 2/1984 | Reedy | 62/528 |
| 4,459,819 | 7/1984 | Hargraves | 62/212 |
| 4,485,635 | 12/1984 | Sakano | 62/209 |
| 4,498,311 | 2/1985 | Sakano et al. | 62/227 |
| 4,539,821 | 9/1985 | Tamura | 62/228.5 |
| 4,633,675 | 1/1987 | Sato | 62/208 |
| 4,637,220 | 1/1987 | Sakano | 62/200 |
| 4,745,767 | 5/1988 | Ohya et al. | 62/211 |
| 4,747,753 | 5/1988 | Taguchi . | |
| 4,753,083 | 6/1988 | Sato | 62/209 |
| 4,773,472 | 9/1988 | Aoki et al. | 165/22 |
| 4,778,348 | 10/1988 | Kikuchi et al. | 417/222 |
| 4,779,425 | 10/1988 | Yoshihisa et al. | 62/199 |
| 4,780,059 | 10/1988 | Taguchi | 417/222 |
| 4,780,060 | 10/1988 | Terauchi | 417/222 |
| 4,788,828 | 12/1988 | Sato | 62/214 |
| 4,840,038 | 6/1989 | Sato | 62/210 |

*Primary Examiner*—William E. Wayner

*Attorney, Agent, or Firm*—Watts, Hoffmann, Fisher & Heinke Co.

[57] ABSTRACT

A flow control valve is disclosed in a household refrigeration appliance having a vapor compression refrigeration system comprising a cyclically operated compressor, a condenser, an evaporator and an expansion device between the condenser and the evaporator. The refrigerant flow control valve is disposed between the condenser and the evaporator and comprises a housing defining a refrigerant flow chamber for receiving liquified refrigerant from the condenser outlet, valve seat structure defining a refrigerant flow port for communicating refrigerant from the condenser to the evaporator, and a flow controlling valve assembly coacting with the valve seat structure to control the refrigerant flow from the refrigerant flow chamber to the expansion device. The flow control valve controls system refrigerant flow in response to subcooling, blocks refrigerant flow from the condenser when the compressor is cycled off and enables circulation of hot gaseous refrigerant under extreme high temperature ambient conditions.

16 Claims, 4 Drawing Sheets

REFRIGERATION SYSTEM SUBCOOLING FLOW CONTROL VALVE

FIELD OF THE INVENTION

This invention relates to refrigeration systems and more particularly to refrigeration systems employing refrigerant flow controlling valves employed in household freezers and the like.

BACKGROUND ART

Refrigeration systems used in household freezers, refrigerators, etc., are designed for low cost and high reliability, both of which require simplicity of design. Typical refrigerators or freezers employ a vapor compression system having an electric motor driven hermetic compressor connected in a circuit with a condenser, evaporator, and a refrigerant flow restriction of some sort between the condenser and the evaporator. In recent times energy conservation requirements have been imposed on these kinds of applicances. The conservation requirements have dictated a using a great deal of additional thermal insulation if system operating efficiencies remain the same as in the past. Adding such insulation would significantly reduce the size of the refrigerated compartment without any a reduction in the outside dimensions of the appliance. Design interest has consequently focussed on increasing refrigeration system operating efficiencies.

Conditions under which household freezers, etc., actually operate vary widely from theoretical design conditions. To accommodate varying conditions these appliances were constructed so that the compressor cycled on and off under control of a thermostat in the refrigerated compartment. When the thermostat was satisfied the compressor stopped. Refrigerant in the condenser continued to flow to the evaporator until the system pressure equalized. Pressure equalization usually occurred after all the liquified refrigerant passed from the condenser into the evaporator. Because the thermostat was satisfied before the refrigerant pressure equalization occurred, the cooling effect produced by the pressure equalizing flow was, in effect, wasted.

When the compressor restarted it was immediately required to reestablish the pressure differential across the system. Gaseous refrigerant thus had to be compressed and recondensed in the condenser for delivery to the evaporator before a significant cooling effect could recur. The pressure equalization flows and the ensuing refrigerant recompressions which such flows necessitated were inefficient.

Proposals were made to avoid inefficiencies created by pressure equalization flows. Some proposals involved using valves for blocking flow to the evaporator from the condenser whenever the compressor turned off. Some valves were solenoid operated and some responded to changes in refrigerant pressure created by the compressor turning on and off. For example, see U.S. Pat. No. 4,267,702 issued May 19, 1981 to Houk.

Pressure equalization flow blocking valves required the compressor to start against relatively high condenser back pressures resulting from the blocked equalization flow. Consequently it was important that the condenser outlet flow be unblocked promptly upon the compressor starting. Some valves were constructed to establish the condenser outlet flow in response to a rise in condenser outlet pressure created by the compressor start-up.

Another source of system inefficiency resulted from passage of hot gaseous refrigerant from the condenser outlet to the evaporator. There the gaseous refrigerant gave up heat to liquified refrigerant in the evaporator, thus reducing the cooling effect. Thus, it was desirable for the refrigerant flow from the condenser outlet to be restricted under conditions where hot gaseous refrigerant could pass to the evaporator (i.e. refrigerant temperature at the condenser outlet is high). Relatively unrestricted refrigerant flows were desirable when the condenser outlet temperatures were low (i.e. during subcooling).

Refrigerant flow modulating valves were proposed which operated in response to liquified refrigerant temperature at the condenser outlet. Some of these also blocked pressure equalization flows when the compressor turned off. See, e.g. U.S. Pat. No. 4,840,038. System efficiency could be improved not only by blocking pressure equalization flows but also by modulating the refrigerant flows to avoid inefficient operating conditions. Such a valve operated to restrict refrigerant flow when condenser outlet temperatures were relatively high and to permit unrestricted flow when condenser outlet temperatures were relatively low.

Owners of household freezers (and of some refrigerators) sometimes station the appliances out-of-doors or in unheated spaces. Where the applicance utilizes a refrigerant flow modulating valve which blocks pressure equalization flows when the compressor is off, problems can be encountered when the temperature ambient of the appliance is low. At low ambient temperatures, i.e. below 50° F. and particularly well below freezing, the condenser temperatures can be so low that when the compressor starts operating it fails to create a sufficient pressure rise to open the valve. When ambient temperatures are low enough, the compressor can pump all the gaseous refrigerant from the evaporator into the condenser without increasing the condenser pressure enough to open the valve.

Failure of the appliance and loss of its contents becomes a distinct possibility in these circumstances. The flow controlling valve remains closed and therefore the thermostat can not be satisfied. The compressor thus operates unceasingly. In these appliances compressor lubricant is typically circulated with the system refrigerant. A likelihood of eventual compressor failure thus exists because of lack of lubrication. Compressor failure occurs unobtrusively and when the ambient temperature rises above freezing the contents of the appliance will eventually spoil.

The present invention provides a new and improved, highly efficient household refrigeration appliance wherein a refrigerant flow controlling valve is provided which controls the flow of liquified refrigerant through an expansion device in response to sensed condenser outlet refrigerant temperature, blocks refrigerant flow from the condenser under normal operating conditions when the compressor is off, yet is open and communicates the condenser outlet with the evaporator when the condenser outlet refrigerant temperature is below a predetermined level.

DISCLOSURE OF THE INVENTION

A household refrigeration appliance constructed according to the present invention comprises a cyclically operated compressor, a condenser, an evaporator, and a refrigerant flow controlling valve for controlling flow between the condenser and the evaporator. The flow controlling valve comprises a valving member movable to and from a valve seat structure for controlling refrigerant flow in response to detected condenser outlet refrigerant temperature. The valving member engages the seat structure to block refrigerant flow from the condenser when condenser outlet refrigerant temperature is above a predetermined level and the compressor is off. The valving member is biased to an open position spaced from engagement with the valve seat structure to communicate the condenser outlet with the evaporator when sensed condenser outlet refrigerant temperature is less than the predetermined level and the compressor is off.

In the preferred embodiment of the invention the valving member is biased toward its open position at temperatures below the predetermined temperature by a resilient metallic member. In a preferred embodiment the flow controlling valve comprises a valve housing defining a refrigerant flow chamber for receiving condenser outlet refrigerant. The valve seat structure defines a refrigerant flow port for communicating refrigerant from the condenser outlet to the evaporator. A refrigerant flow controlling valve assembly, formed in part by the valving member, coacts with the valve seat structure to control refrigerant flow from the refrigerant flow chamber.

In one preferred flow controlling valve assembly an expansible chamber actuator shifts the valving member between operating positions. The actuator contains a vaporizable fill fluid in a liquid and saturated vapor state. The actuator comprises a resiliently deflectable actuator chamber wall member which deflects resiliently to move the valving member and exerts a biasing force on the valving member in a direction to open the valve when the refrigerant flow chamber temperature is below the predetermined temperature.

In this embodiment the actuator chamber fill fluid has a saturated vapor pressure-temperature characteristic curve whose slope is steeper than that of the system refrigerant. At low temperature the chamber wall member biases the valving member so that it is open when the compressor is off.

In another embodiment of the invention the valving member is engaged and biased toward its open position at temperatures below the predetermined temperature by a temperature responsive biasing member. The illustrated temperature responsive biasing member comprises a bimetal member which changes configuration in response to temperature changes.

Other features and advantages of the invention will become apparent from the following detailed description of preferred embodiments made in reference to the accompanying drawings.

BEST MODE FOR PRACTICING THE INVENTION

Figure 1:
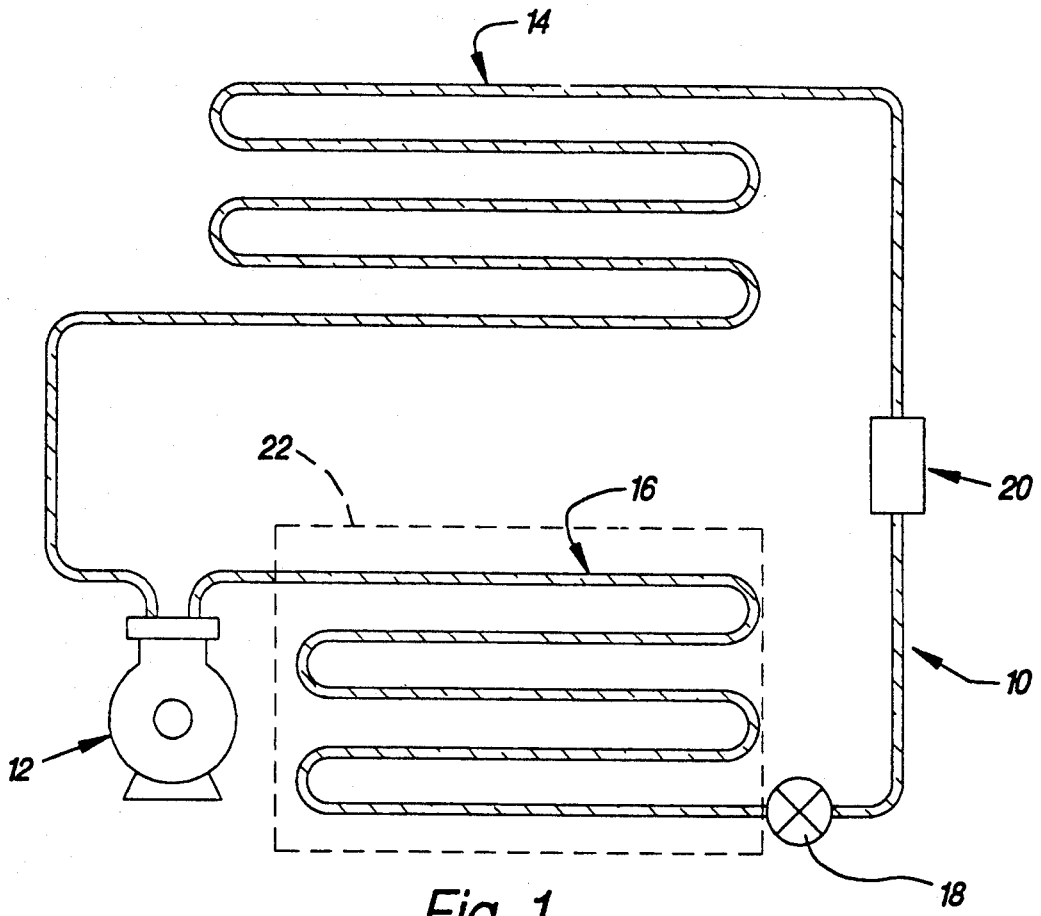
FIG. 1 is a schematic representation of a refrigeration system embodying a refrigerant flow control valve constructed according to the present invention.

A vapor compression refrigeration system 10 of the sort used in a household refrigerator or freezer is schematically illustrated in FIG. 1. The system 10 is a hermetic circuit containing a refrigerant, preferably R12. The system 10 comprises a compressor 12, a condenser 14, an evaporator 16, an expansion device 18 between the condenser and the evaporator, and a refrigerant flow controlling valve 20 between the condenser and the expansion device 18. The compressor circulates the refrigerant through the system 10 so that heat is transferred from a frozen food compartment 22 to the atmosphere ambient the system as the refrigerant successively evaporates and condenses in the evaporator and condenser. A thermostat (not illustrated) in the compartment 22 cyclically operates the compressor so that the compartment temperature is maintained within desired limits.

The compressor 12 compresses gaseous refrigerant flowing from the evaporator and delivers it, at an elevated temperature, to the condenser. The condenser transfers heat from the refrigerant flowing through it to atmospheric air so that the refrigerant condenses in the condenser. Liquified refrigerant flows from the condenser through the expansion device 18 after which it enters the evaporator, having undergone a substantial pressure reduction.

The system geometry is such that the liquified refrigerant collects at the discharge end of the condenser before entering the expansion device. The expansion device 18 is preferably formed by a long, small bore capillary tube. The capillary tube design is "loose" in that the tube bore is sufficiently large to pass flows of the liquid refrigerant sufficient to relatively quickly flood the evaporator with liquid refrigerant when the compressor starts up.

Even though the capillary design is "loose," a quantity of the liquified refrigerant, substantially at the compressor discharge pressure, tends to be maintained in the downstream condenser end when the compressor is operating. The condenser continues to transfer heat from this liquified refrigerant so its temperature drops below the condensation temperature corresponding to the condenser pressure. This refrigerant condition is known as "subcooling." The extent of the subcooling depends upon various system operating conditions.

The refrigerant flow controlling valve 20 varies the refrigerant flow rate from the condenser to the evaporator according to refrigeration system operating parameters to assure efficient operation. The flow controlling valve 20 coacts with the expansion device 18 so that the rate of refrigerant flow into the evaporator varies between zero and the maximum flow permitted by the expansion device acting alone. This coaction enables the refrigeration system to quickly flood the evaporator when the compressor initially operates at the beginning of an "on" cycle (the expansion device being of "loose" design), yet virtually precludes the flow of any substantial amounts of gaseous refrigerant into the evaporator under normal operating conditions.

Figure 2:
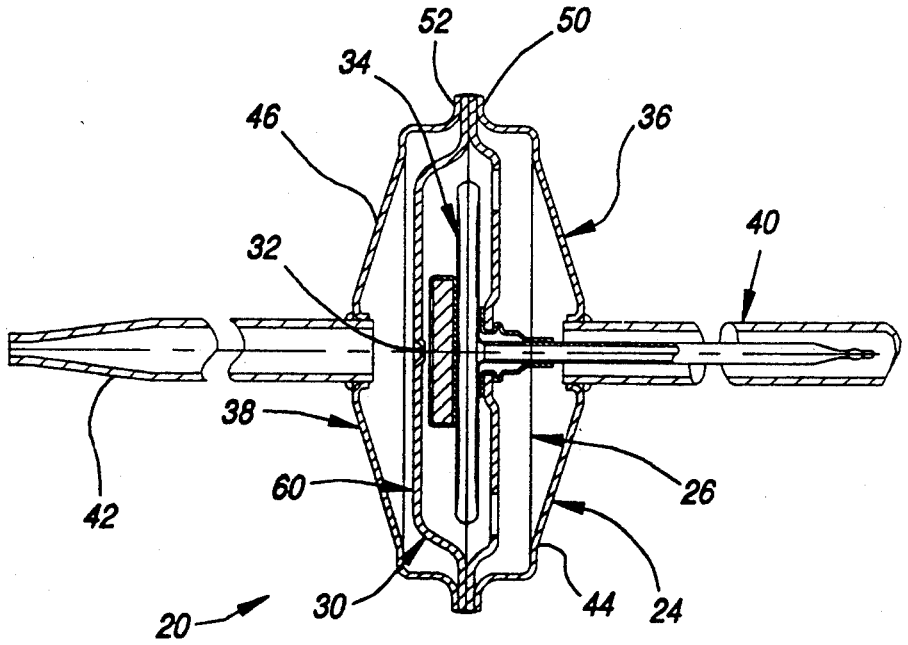
FIG. 2 is a cross sectional view of a preferred refrigerant flow controlling valve constructed according to the present invention.
Figure 3:
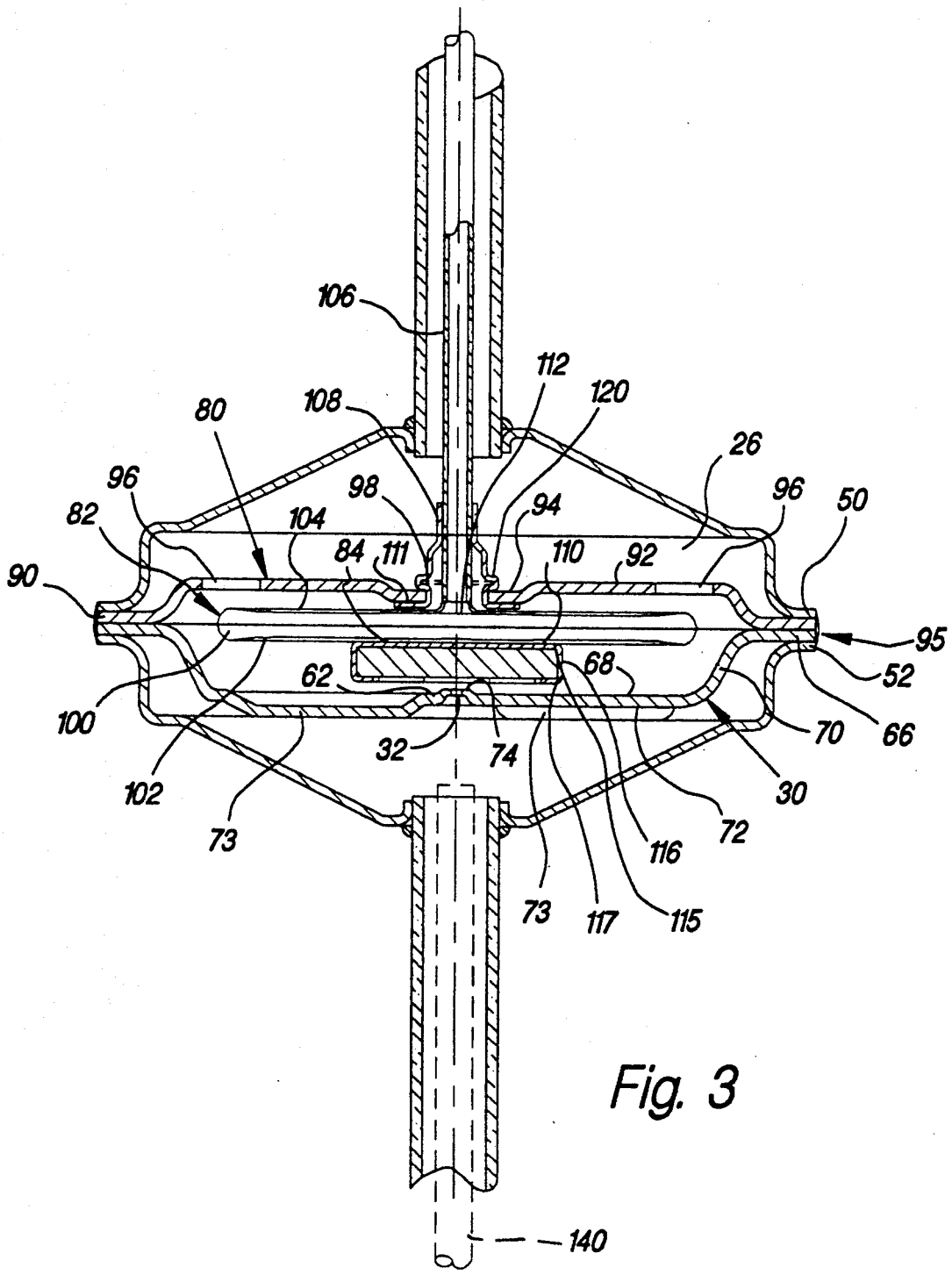
FIG. 3 is an enlarged cross sectional view of part of the flow controlling valve of FIG. 2.

The preferred valve 20, illustrated in FIGS. 2 and 3, is particularly adapted for use in a household freezer. The valve 20 comprises a valve housing 24 defining a refrigernat flow chamber 26 in communication with the refrigerant condenser, a valve seat structure 30 forming a port 32 leading to the expansion device 18, and a refrigerant flow controlling valve assembly 34 coacting with the valve seat structure to control the flow of refrigerant from the refrigerant flow chamber.

The valve housing 24 communicates the condenser 14 to the expansion device 18 and comprises first and second housing members 36, 38 forming the refrigerant flow chamber 26 and refrigerant flow conduits 40, 42, respectively, for directing the refrigerant into and away from the refrigerant flow chamber. The housing members 36, 38 are formed by respective concave confronting cup-like portions 44, 46, having confronting peripheral flanges 50, 52 hermetically secured together about the chamber 26. The conduits 40, 42 are illustrated as comprising refrigerant flow tubes projecting, respectively, to sealed, bonded (preferably brazed) joints (not shown) with the condenser 14 and the expansion device 18. The flow tubes are also joined to their respective housing members by sealed, bonded joints such as brazed connections.

The housing 24 is oriented with the conduit 40 extending upwardly to the condenser and the conduit 42 extending vertically downwardly to the device 18 (see FIG. 3). The chamber 26 is preferably below the lowest condenser elevation so liquified refrigerant from the condenser flows to the chamber and gaseous refrigerant remains above the liquid refrigerant level. Under most operating conditions the chamber 26 is flooded with the liquified refrigerant.

The flow control valve seat structure 30 forms part of the refrigerant flow chamber and in the valve illustrated in FIG. 3 comprises a seat support member 60 disposed in the chamber 26 and a valve seat 62 surrounding the refrigerant flow port 32. The illustrated seat support member 60 is formed by a plate having an outer marginal flange 66 hermetically joined between the confronting housing member flanges 50, 52 and a central support section 68 for the seat 62. The central section 68 defines a frustoconical wall 70 adjoining the flange 66, a generally planar annular wall 72 between the wall 70 and the seat 62, and a series of radially extending stiffening ribs 73 embossed in the wall 70. The rib embossments project from the plane of the wall 72 in the direction away from the valving member and in the illustrated valve 20, three ribs are provided extending 120 degrees apart about the port axis.

The valve seat 62 projects from the central section 68 and is illustrated in FIGS. 2 and 3 as formed by a central, drawn and pierced projection forming the port 32. The seat region immediately surrounding the port 32 is defined by an annular rim 74 having a sharply radiused projecting edge for contacting the valving structure 34. The rim 74 is quite narrow and the port 32 has a small area. The rim and port areas are slight to make negligible any differential pressure force changes acting on the valving structure when the flow controlling valve 20 is closed or nearly closed. The small rim area also reduces possible effects of localized transient pressure forces caused by high velocity refrigerant flows between the rim and the valving member when the valve is nearly closed.

The flow controlling valve assembly 34 governs refrigerant flow through the port 32 in relation to sensed refrigeration system conditions. The valve assembly 34 comprises a valve supporting structure 80 fixed with respect to the housing, an actuator 82, and a valving member 84 connected to the actuator for movement into and away from engagement with the valve seat structure for controlling the flow of refrigerant from the refrigerant flow chamber 26.

The valve supporting structure 80 is fixed in the chamber 26 for rigidly positioning and locating the actuator 82 and the valving member 84 with respect to the valve seat structure 30. The valve supporting structure 80 illustrated in FIGS. 2 and 3 comprises a rigid, stamped sheet metal plate having an outer peripheral flange section 90, an annular body section 92, and a central, actuator support flange section 94. The flange section 90 is circular and conformed to the size and shape of the housing flanges. The section 90 is sandwiched between the housing flange 50 and the seat structure marginal flange 66 and is hermetically joined to the housing flanges 50, 52 and the marginal flange 66 by a continuous circumferential weld joint 95.

The body section 92 extends through the chamber 26 between the flange section 90 and the support flange 94. In the illustrated embodiment the body section forms an annular corrugation in the valve support structure. A series of refrigerant flow openings 96 is formed about the body section to permit unrestricted refrigerant flow through the chamber. The corrugated shape of the body section assures that the body section remains structurally strong and stiff regardless of the presence of the openings 96.

The actuator support flange 94 is a short, stiff annulus which surrounds a central actuator receiving opening 98. The flange 94 stiffly supports the actuator 82 generally along the center-line of the chamber 26.

The actuator 82 is constructed and arranged to shift the valving member 84 between fully opened and fully closed positions and to control the valving member position to modulate flow depending on sensed refrigerant temperature and pressure conditions. The preferred actuator 82 is an expansible chamber pressure actuator having a hermetic expansible operating chamber 100 filled with an operating fluid. The operating fluid is in both its liquid and vapor phases under normal operating conditions so the internal chamber pressure varies with temperature according to the pressure-temperature characteristics of the fill fluid saturated vapor. The fill fluid of the FIGS. 2 and 3 actuator is preferably R 500.

The preferred actuator comprises a stiffly resilient metal diaphragm 102 forming a movable wall of the operating chamber 100 and carrying the valving member. The positoin of the diaphragm 102 relative to the valve seat structure is determined by the refrigerant pressure in the chamber 26, the pressure of the fill fluid in the operating chamber 100 and the internal diaphragm spring force.

In the illustrated and preferred embodiment of the invention the actuator 82 is formed by a stiffly resilient single convolution metal bellows comprised of the diaphragm 102, a second diaphragm 104, a fill tube 106, a supporting eyelet 108, and an extension member 110. The diaphragms 102, 104 are stamped from a thin (e.g. 0.006 inch thick) leaf of stainless steel spring material and are initially identical dished discs.

The "top" (or uppermost, as viewed in the drawing, FIG. 3), diaphragm 104 is constructed to be anchored to the supporting structure 80 by the eyelet 108 which is formed by a malleable metal straight cylindrical sleeve-like body having an annular end flange 111. The eyelet end flange 111 is welded to the centerline of the disc about the opening and the diaphragm is pierced to form a central opening 112 along its centerline.

The "bottom" diaphragm 102 carries the valving member 84 on the extension member 110. The extension member illustrated by FIGS. 2 and 3 comprises a flat cylindrical cup-like body stamped from sheet metal. The body has a flat circular base 115, a cylindric wall 116, and projecting fingers 117 disposed about the projecting edge of the wall. The base 115 is welded securely to the diaphragm 102 with the wall 116 and fingers 117 projecting towards the valve seat.

The diaphragm discs are aligned in confronting relationship and bonded together about their peripheries by a continuous hermetic weld to provide the operating chamber 100 between them. The partially completed bellows is assembled to the supporting structure 80 with the eyelet 108 extending through the receiving opening 98. The eyelet is upset to form an outwardly extending corrugation 120 which clamps the eyelet firmly to the flange 94. The cylindrical end of the eyelet is swaged at the same time to reduce its diameter to approximate that of the fill tube 106.

The fill tube 106, initially open at both ends, is inserted in the eyelet end and hermetically brazed to the eyelet. The valving member 84 is inserted into the extension cup 110 and the fingers 117 are crimped into engagement with the valving member to secure it in place. The cup wall 116 extends just beyond the valving member toward the valve seat.

The preferred valving member 84 is a flat cylindrical disc defining a generally flat valving face confronting the valve seat. The valving face has an area which is quite large compared to the area of the port 32. The preferred and illustrated valving member 84 is composed of a tough, somewhat resilient plastic material, preferably polytetrafluoroethylene (e.g. Teflon) or equivalent, which is resiliently deflected when moved into positive sealing engagement with the valve seat without being cut or abraded by the rim 74. The valving member should be at least some what resilient to assure that the valving member 84 returns substantially to its undeflected condition when the valve is open. The rim of the extension cup wall 116 engages the seat structure wall 72 after the valve fully closes to limit compression of the valving member if the actuator exerts excessive force after closing the valve.

It should be noted that the ribs 73 form radially extending channels in the otherwise planar seat structure wall 72. These channels communicate refrigerant at flow chamber pressure to most of the valving member face even when the valve 20 is tightly closed. The small valving member face area occupied by the valve port 32 is insufficient to create a material differential pressure force on the valving member.

The Teflon or equivalent plastic material is preferred because it does not react with compressor lubricating oil circulating in the system with the refrigerant. Other materials, such as synthetic rubbers or other elastomers, can be used for the valving member so long as they are compatible with the system refrigerant and the compressor lubricant.

The bellows is charged with the fill fluid in such a way that the flow controlling valve is opened at both the high and low ambient temperature operating extremes of the freezer (regardless of the operating condition of the compressor); the flow controlling valve closes when the compressor cycles off during normal operation; and the valve modulates the refrigerant flow in response to predetermined subcooling conditions. A predetermined quantity of fill fluid is introduced to the bellows via the fill tube 106. Charging is carried out under strictly controlled pressure and temperature conditions so that under normal flow controlling valve operating conditions the bellows operates "above" (i.e. at greater than) its free height. That is, the bellows is extended against its own inherent spring force. In this charging condition, when the differential fluid pressure across the bellows diaphragms is zero the bellows force is relaxed and the bellows "retracts" to its free height. The flow controlling valve is opened in this condition. When the bellows has been charged with the proper amount of fluid the projecting fill tube end is crimped and sealed closed.

The fill fluid in the flow controlling valve of FIGS. 2 and 3 (R 500) is selected so that its saturated vapor pressure-temperature characteristic curve has, through the normal operating temperature range, a steeper slope than that of the system refrigerant (in this case R12). See FIG. 4 where the fill fluid saturated vapor pressure-temperature curve 132 is depicted with the refrigerant saturated vapor pressure-temperature curve 134. When the spring force of the bellows is taken into account, the effective fill fluid pressure-temperature characteristic curve is as illustrated by the line 135 of FIG. 4.

When the refrigerant and the fill fluid are both at temperatures ranging below about 50F the effective fill fluid valve pressure (curve 135) ranges from about the same as to substantially less than the saturated refrigerant vapor pressure (curve 134). This condition results in the bellows retracting toward its free height so the valve 20 opens.

When the fill fluid and refrigerant are at relatively normal operating temperature levels, e.g. above 50F, the effective fill fluid pressure is markedly higher than the saturated refrigerant vapor pressure. The bellows extends above its free height and the valve closes if the compressor is not operating. If the compressor operates under these conditions the valve opens and may or may not modulate the refrigerant flow depending on sensed conditions.

Figure 4:
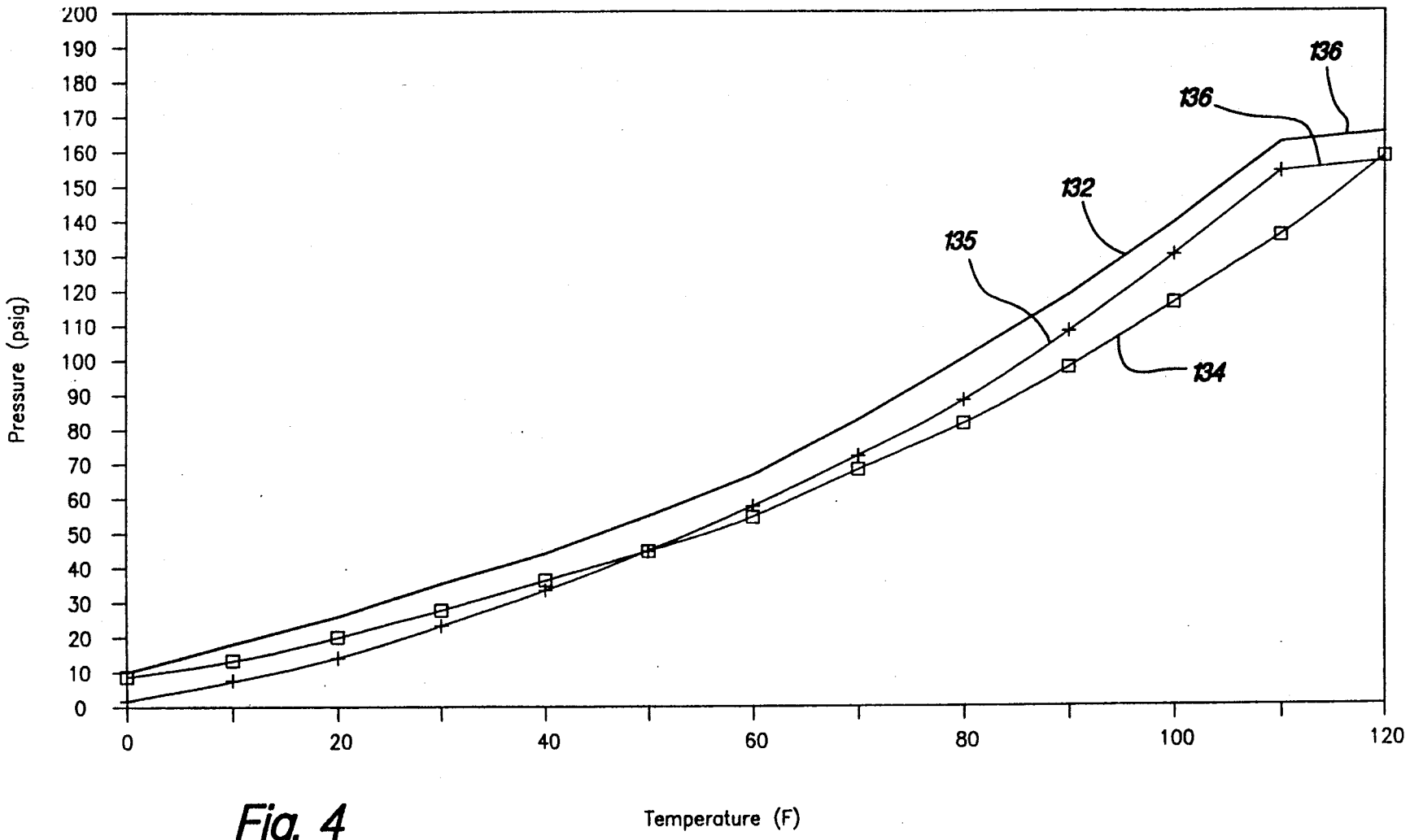
FIG. 4 is a graphic representation of vapor pressure versus temperature curves of system refrigerant and flow controlling valve operating fluid; and, FIG. 5 is a cross sectional fragmentary view of a modified refrigerant flow controlling valve constructed according to the present invention.

At an ambient temperature around 110F the fill fluid completely evaporates. As the ambient temperature increases from the level the fill fluid vapor is superheated. The superheated vapor pressure-temperature characteristic curve approximates that of a so-called "perfect" gas (i.e. the slope of the pressure-temperature curve is much less than that of the refrigerant vapor pressure-temperature curve). This is illustrated in FIG. 4 at line segment 136. As a consequence, the saturated refrigerant pressure at elevated temperatures rises above the actuator operating chamber pressure and the bellows retracts to fully open the valve 20. The ambient temperature at which the fill fluid evaporates is determined by the quantity of fill fluid introduced into the actuator.

The actuator assembly and the valve seat structure are assembled with their flange peripheries aligned and then placed between the housing cups. The assembled elements are fixtured with all the outer flange peripheries aligned and the fill tube 106 extending part way through its associated conduit. The assembly is completed by welding the flanges 50, 52, 66 and, 90 to form the hermetic joint 95 about the flange junctures.

Calibration is accomplished by establishing predetermined conditions within the flow controlling valve and distorting the structure of the valve 20 to shift the relative positions of the port 32 and the valving member 84. An example of one calibration technique is to establish a given flow of air through the valve 20 at a predetermined pressure and temperature by yielding the valve seat supporting structure a controlled amount.

In one series of flow controlling valves it has been found that operationally satisfactory valves are so constructed and arranged that when such a valve is at a temperature of 70° F. (21° C.) and supplied with air or Nitrogen at that temperature and 78 psig, a flow rate of 0.15 scfm is established through the valve. To calibrate an uncalibrated valve, the valve is maintained at 70° F. and supplied with 70° F. and supplied with 70° F. Nitrogen or air until a flow rate of 0.15 scfm is observed. The gas pressure at this flow rate is less than 78 psig.

A calibration ram 140 (schematically illustrated in FIG. 3) inserted in the conduit 42 is forced against the seat support structure while the flanges 50, 52, 66 and 90 are securely held in place. The "bumping" force applied to the seat yields the support section 68 so that the rim 74 is moved toward the valving member 84. This increases the gas pressure required to achieve a 0.15 scfm flow rate. The process is repeated as necessary until the 78 psig - 0.15 scfm calibration condition has been established.

In the preferred valve 20, the supporting section 68 is yielded in a generally circular path extending about the radially outer ends of the embossed ribs 73. The ribs are quite stiff and thus dictate where the yielding deflection takes place and thus aid in assuring reliable calibration.

When the calibration is completed the outlet conduit 42 is swaged to reduce the diameter of its outlet and the completed valve 20 is ready for assembly into a freezer unit refrigeration system. In the preferred construction the valve 20 is brazed into the refrigeration system and oriented so refrigerant flow through the valve occurs generally vertically downwardly from the condenser through the valve 20 toward the expansion device 18. This valve orientation tends to reduce the possibility of reduced pressure refrigerant remaining in the vicinity of the seat supporting structure after passing through the port 32 and evaporating there. Such evaporation could cause conductive heat transfer from the actuator fill fluid through the extension member 110 and the valving member 84, to the evaporating refrigerant via the valve seat structure.

The fill fluid vapor pressure depends on the temperature of the coolest actuator location because the temperature governs condensation of the fill fluid. Conductive heat transfer away from the actuator might thus cause inappropriate actuator response because the actuator would respond to the evaporating refrigerant temperature downstream from the valve port 32 rather than the refrigerant temperature in the flow chamber 26.

After the valve 20 is installed in the freezer the refrigeration system is charged with refrigerant and the system is operated. During normal operation, at relatively high ambient temperatures, the flow controlling valve 20 tends to be open when the compressor is running. In this operating condition the valving member 84 is positioned according to the lowest flow chamber refrigerant temperature detected by the actuator 82. If the refrigeration system is heavily loaded (for example when a large quantity of room temperature meat has just been placed in the freezer) the flow chamber refrigerant temperature is relatively high, signifying that the undesirable passage of hot gas through the expansion device might be imminent. The operating chamber pressure increases as the refrigerant temperature increases so the valving member moves toward the port 32 and restricts the refrigerant flow from the flow chamber 26. This action tends to minimize the possibility of hot gas flowing through the expansion device into the evaporator.

As the system load is reduced (for example when the freezer contents reach the thermostat set point temperature) the quantity of liquified refrigerant at the condenser discharge end is increased and refrigerant in the flow chamber is subcooled. Accordingly the flow chamber refrigerant temperature is reduced resulting in the valving member retracting from the valve port so the refrigerant flows in a less restricted way from the chamber.

When the food compartment thermostat is satisfied the compressor is cycled "off" and the flow controlling valve 20 closes promptly so that the refrigerant in the condenser remains there at high pressure during the time the compressor is not operating (freezer compartment cooling is not called for). When the compressor cycles "off" the pressure in the condenser drops precipitately toward the saturated vapor pressure of the refrigerant in the condenser. The forces acting on the actuator diaphragm promptly come into balance with the actuator stabilizing in its extended position so the flow controlling valve 20 is closed. The forces acting on the diaphragm are the fill fluid vapor pressure force; the bellows spring force; and, the refrigerant vapor pressure force. The spring and the refrigerant pressure forces oppose the fill fluid pressure force and balance the fill fluid pressure force when the bellows is positioned "above" its operating height with the valve closed.

The valve 20 opens automatically when the compressor restarts. The thermostat calls for compartment cooling by turning the compressor "on" and the condenser pressure rises to the compressor discharge level. This creates additional pressure force acting on the actuator bellows in opposition to the fill fluid pressure force. Assuming normal operating conditions, the bellows retracts and the valve 20 opens. This feature of the valve 20 also provides for failsafe operation in that if the actuator operating fluid chamber should leak or be holed for any reason, the fluid pressures acting on the bellows would be balanced and the valve would open due to the diaphragm spring force.

Household freezers are sometimes located in unheated spaces (such as garages), or even out-of-doors (for example on open porches), where the atmospheric temperature ambient the freezer may be quite low. In such environments freezers are quite lightly loaded but compressors do cycle periodically because compartment temperature set points are below the ambient air temperature so that compartment heat occur. At low ambient temperatures the system temperature is so low that operation of the compressor may not produce an appreciable condenser pressure rise.

Accordingly, when the compressor cycles "on," the condenser pressure may not be relied on to increase sufficiently to open the flow controlling valve 20. If the valve 20 remains closed the food compartment thermostat can not be satisfied and the compressor continues operating without cycling. All the system refrigerant may be delivered into the condenser. Since the compressor lubricating oil is circulated in the system by the refrigerant the compressor can be damaged from insufficient lubrication.

The preferred flow controlling valve is biased to its open condition when the ambient temperature is low. The preferred valve 20 thus enables continued system refrigerant flow at low ambient temperatures regardless of the compressor operating condition. This operational feature protects the compressor without materially reducing the refrigeration system operating efficiency because the system is extremely efficient at low ambient temperatures anyway.

As noted previously the flow controlling valve 20 illustrated by FIGS. 2 and 3 employs an actuator bellows filled with a fluid (R 500) whose saturated vapor pressure-temperature curve is sloped more steeply than the saturated vapor pressure-temperature curve of the system refrigerant (R 12). Comparing the curve 134 and 135 of FIG. 4 reveals that at low ambient temperatures the system refrigerant vapor pressure force and the diaphragm spring force exceed the actuator operating fluid pressure force. Thus the actuator is biased to open the valve 20.

The valving member 84 is moved only a short distance between its full flow and fully closed positions. When the valving member is between these limiting flow positions the refrigerant flow through the port is modulated so that the refrigerant pressure drop between the condenser and the evaporator varies in accordance with the degree of refrigerant subcooling. The preferred single convolution bellows is quite stiff and has a relatively linear spring characteristic through the range of valving member positions between closed and full flow. That is, the actuator spring force opposing extension of the bellows remains substantially constant over the operating range of bellows positions. The flow controlling valve is thus quite sensitive in its response to detected refrigerant pressure and temperature conditions indicative of the degree of its subcooling.

Figure 5:
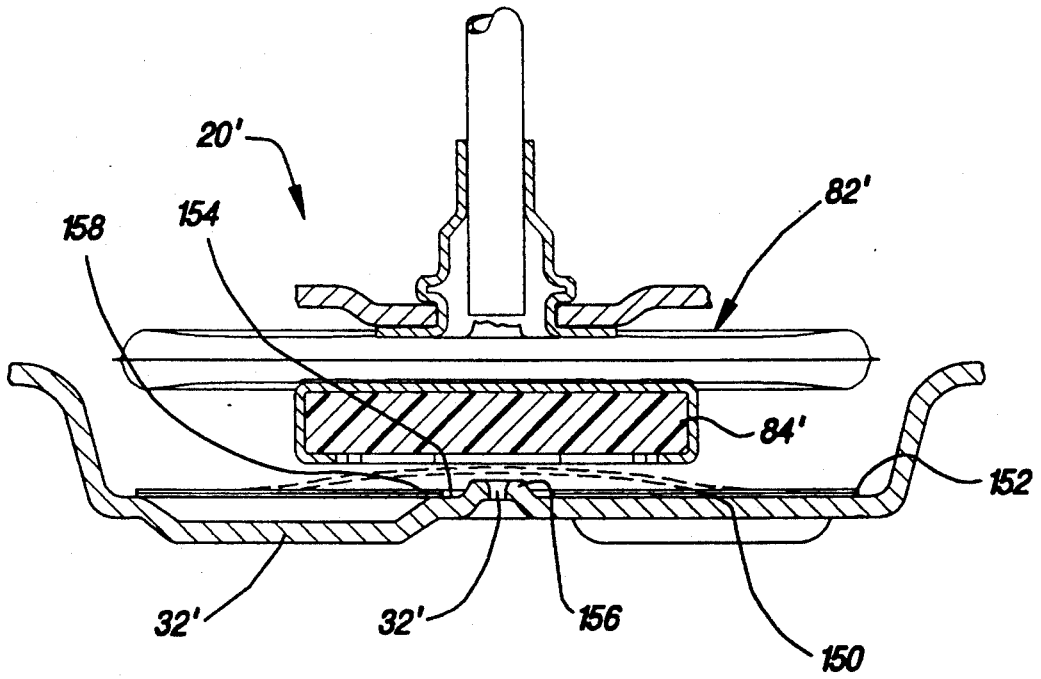

FIG. 5 illustrates part of an alternative refrigerant flow controlling valve construction wherein the valving member blocks refrigerant flow from the condenser when condenser outlet refrigerant temperature is above a predetermined level and the compressor is off, yet is biased to an open position to communicate the condenser outlet with the evaporator when sensed condenser outlet refrigerant temperature is less than the predetermined level and the compressor is off. The FIG. 5 valve is constructed primarily from parts which are the same as those described above in reference to FIGS. 1–3 with corresponding parts indicated by like, primed reference characters.

The valve 20' of FIG. 5 differs from the valve 20 in that when the flow chamber temperature is below the predetermined temperature (e.g. 50F or below) and the compressor is off, the valving member 84' is biased to its open position by a thermally responsive biasing member 150. In addition, the actuator fill fluid is the same as that used as the system refrigerant.

In the illustrated embodiment the biasing member 150 comprises a bimetal element which changes its configuration in response to sensed temperatures below the predetermined level and in so doing engages the valving member 84' to prevent it from closing the port 32'. The illustrated bimetal member is in the form of a two layer disc seated on the seat structure wall 72' with its outer periphery 152 tack welded to the wall 72'. The disc layer confronting the wall 72' has a smaller coefficient of thermal expansion and contraction than that of the layer confronting the valving member 84'. A circular eye 154 is formed at the center of the disc through which the valve seat 156 projects. The valve seat 156 differs from the seat 62 in that the seat 156 projects slightly further from the wall 72' than would the seat 62 in order to accommodate the thickness of the bimetal disc.

In the FIG. 5 embodiment the actuator 82' is constructed like the actuator 82 except the actuator fill fluid is the same as the system refrigerant (in this case R 12). The actuator 82' is filled so that when the internal and external actuator pressures are the same, the actuator diaphragm spring force urges the valving member 84' into engagement with the seat 156 to close the port 32'. This typically occurs when the compressor is off; but when ambient temperatures are very low the same condition can persist after the compressor has begun to run. This can result in damage to the system as is noted previously.

The biasing member 150 prevents the valving member from closing on the seat 156 at low ambient temperatures by buckling into a generally frusto-conical shape with its inner periphery 158 lifting away from the wall 72' and engaging the valving member 84' to block its motion toward the seat. This condition is illustrated by broken lines in FIG. 5. The valving member is thus prevented from closing at low temperature when the compressor is off. When temperatures are above the predetermined temperature the bimetal member hugs the wall and does not interfere with operation of the valve 20'.

While different preferred embodiments of the invention have been illustrated and described in detail the invention is not to be considered limited to the precise constructions disclosed. Various adaptations, modifications and uses of the invention may occur to those skilled in the art to which the invention relates. The intention is to cover all such adaptations, modifications and uses which fall within the scope or spirit of the appended claims.

Having described our invention we claim:

1. In a household refrigeration appliance having a compartment chilled by a vapor compression refrigeration system comprising a cyclically operated compressor, a condenser, an evaporator and expansion means between the condenser and the evaporator; a refrigerant flow controlling valve between the condenser and the evaporator, said refrigerant flow controlling valve comprising:

a. a valve housing defining a refrigerant flow chamber receiving liquified refrigerant from the condenser;

b. valve seat structure defining a refrigerant flow port for communicating refrigerant from said flow chamber to the evaporator; and, c. a refrigerant flow controlling valve assembly coacting with said valve seat structure to control the flow of refrigerant from said refrigerant chamber, said flow controlling valve assembly comprising:

i. a valve supporting structure fixed with respect to said housing;

ii. an expansible chamber actuator containing a vaporizable fluid in heat transfer relationship with refrigerant in said flow chamber, said actuator controlled by the refrigerant pressure and temperature in said flow chamber; and, iii. a valving member connected to said actuator for movement between a closed position where said valving member engages said valve seat structure and an open position spaced from engagement with said valve seat structure;

iv. said valving member biased toward said open position in response to sensed refrigerant flow chamber temperatures below a predetermined temperature so that said refrigerant flow chamber is communicated to said evaporator when said compressor is off.

2. The appliance claimed in claim 1 wherein said actuator comprises a resiliently deflectable actuator chamber wall member, said wall member deflecting resiliently to move said valving member and exerting a biasing force on said valving member in a direction to open said valve when the refrigerant flow chamber temperature is below said predetermined temperature.

3. The appliance claimed in claim 1 wherein said valving member is engaged and biased toward said open position at temperatures below the predetermined temperature by a temperature responsive biasing member.

4. The appliance claimed in claim 3 wherein said temperature responsive biasing member comprises a bimetal member which changes configuration in response to temperature changes.

5. The appliance claimed in claim 1 wherein said vaporizable fluid in said actuator exhibits a vapor pressure-temperature curve having a slope which is steeper than that of the refrigerant vapor pressure-temperature curve and said actuator comprises spring means coacting with the refrigerant vapor pressure force in opposition to the vaporizable fluid vapor pressure force at temperatures below the predetermined temperature to maintain said valving member open when said compressor is off.

6. The appliance claimed in claim 5 wherein said system refrigerant is R12 and said fill fluid is R500.

7. A household vapor compression refrigeration appliance comprising a cyclically operated compressor, a condenser, an evaporator, and a refrigerant flow controlling valve for controlling flow between the condenser and the evaporator, said flow controlling valve comprising:

a. a valve housing defining a refrigerant flow chamber for receiving liquified refrigerant from the condenser outlet;

b. valve seat structure defining a refrigerant flow port for communicating refrigerant from the condenser outlet to the evaporator; and, c. a refrigerant flow controlling valve assembly coacting with the valve seat structure to control refrigerant flow from the refrigerant flow chamber, said valve assembly comprising a valving member movable to and away from said valve seat structure for controlling refrigerant flow in respose to detected condenser outlet refrigerant temperature, said valving member engaging said seat structure to shut off refrigerant flow from the condenser outlet to the evaporator when flow chamber refrigerant temperature is above a predetermined level and the compressor is off so that condenser pressure is maintained above evaporator pressure while the compressor is off, said valving member biased to an open position spaced from engagement with said valve seat structure to communicate the condenser outlet with the evaporator when sensed condenser outlet refrigerant temperature is less than said predetermined level and the compressor is off.

8. The appliance claimed in claim 7 wherein said valving member is biased to the open position by a temperature responsive member.

9. The appliance claimed in claim 8 wherein said temperature responsive member is a bimetal element.

10. A household vapor compression refrigeration appliance comprising a cyclically operated compressor, a condenser, an evaporator, and a refrigerant flow controlling valve for controlling flow between the condenser and the evaporator, said flow controlling valve comprising:

a. a valve housing defining a refrigerant flow chamber for receiving liquified refrigerant from the condenser outlet;

b. valve seat structure defining a refrigerant flow port for communicating refrigerant from the condenser outlet to the evaporator; and, c. a refrigerant flow controlling valve assembly coacting with the valve seat structure to control refrigerant flow from the refrigerant flow chamber, said valve assembly comprising a valving member movable to and away from said valve seat structure for controlling refrigerant flow in response to detected condenser outlet refrigerant temperature, said valving member engaging said seat structure to block refrigerant flow from the condenser when flow chamber refrigerant temperature is above a predetermined level and the compressor is off, said valving member biased to an open position spaced from engagement with said valve seat structure to communicate the condenser outlet with the evaporator when sensed condenser outlet refrigerant temperature is less than said predetermined level and the compressor is off; and, d. an expansible chamber actuator connected to said valving member for moving said valving member, said actuator biasing said valving member to said open position at temperatures below said predetermined temperature.

11. The appliance claimed in claim 10 wherein said actuator contains a fill fluid in a liquid and saturated vapor state when temperatures are at or below the predetermined temperature, said fill fluid having a saturated vapor pressure-temperature response curve which is steeper than that of the system refrigerant, said actuator further including a stiffly resilient diaphragm connected to said valving member, said diaphragm resiliently opposing the pressure force of said fill fluid at temperatures below said predetermined temperature and resiliently urging said valving member to the open position.

12. The appliance claimed in claim 10 wherein at least part of said actuator is disposed in said refrigerant flow chamber in heat transfer relationship with refrigerant in said flow chamber, said actuator containing a fill fluid in a liquid and saturated vapor state when temperatures are at or below the predetermined temperature, said fill fluid having a saturated vapor pressure-temperature response curve which is steeper than that of the system refrigerant, said fill fluid in heat transfer relationship with said refrigerant in said flow chamber.

13. A household refrigeration appliance comprising a cyclically operated compressor, a condenser, an evaporator, and a refrigerant flow controlling valve for controlling flow between the condenser and the evaporator; the flow controlling valve comprising:

a. a valving member movable to and from a valve seat structure for controlling refrigerant flow in response to detected condenser outlet refrigerant temperature;

b. the valving member engaging the seat structure to shut off refrigerant flow from the condenser to the evaporator when condenser outlet refrigerant temperature is above a predetermined level and the compressor is off so that the condenser pressure remains elevated above the evaporator pressure while the compressor is off;

c. the valving member biased to an open position spaced from engagement with the valve seat structure to communicate the condenser outlet with the evaporator when sensed condenser outlet refrigerant temperature is less than the predetermined level and the compressor is off.

14. A household refrigeration appliance comprising a cyclically operated compressor, a condenser, an evaporator, and a refrigerant flow controlling valve for controlling flow between the condenser and the evaporator; the flow controlling valve comprising:

a. a valving member movable to and from a valve seat structure for controlling refrigerant flow in response to detected condenser outlet refrigerant temperature;

b. the valving member engaging the seat structure to block refrigerant flow from the condenser when condenser outlet refrigerant temperature is above a predetermined level and the compressor is off;

c. the valving member biased to an open position spaced from engagement with the valve seat structure to communicate the condenser outlet with the evaporator when sensed condenser outlet refrigerant temperature is less than the predetermined level and the compressor is off; and, d. an expansible chamber actuator connected to said valving member for moving said valving member, said actuator biasing said valving member to said open position at temperatures below said predetermined temperature.

15. The appliance claimed in claim 14 wherein said actuator contains a fill fluid in a liquid and saturated vapor state when temperatures are at or below the predetermined temperature, said fill fluid having a saturated vapor pressure-temperature response curve which is steeper than that of the system refrigerant, said actuator further including a stiffly resilient diaphragm connected to said valving member, said diaphragm resiliently opposing the pressure force of said fill fluid at temperatures below said predetermined temperature and resiliently urging said valving member to the open position.

16. The appliance claimed in claim 14 wherein at least part of said actuator is disposed in said refrigerant flow chamber in heat transfer relationship with refrigerant in said flow chamber, said actuator containing a fill fluid in a liquid and saturated vapor state when temperatures are at or below the predetermined temperature, said fill fluid having a saturated vapor pressure-temperature response curve which is steeper than that of the system refrigerant, said fill fluid in heat transfer relationship with said refrigerant in said flow chamber.

* * * * *